United States Patent [19]

Kavis

[11] 4,090,754

[45] May 23, 1978

[54] THEATER CABINET TABLE

[76] Inventor: George Kavis, 355 E. 146th St., Harvey, Ill. 60426

[21] Appl. No.: 766,960

[22] Filed: Feb. 9, 1977

[51] Int. Cl.[2] ..... A47B 47/00

[52] U.S. Cl. ..... 312/196; 312/22; 353/79

[58] Field of Search ..... 312/20, 21, 223, 237, 312/196; 352/104; 353/79, 119, 17

[56] References Cited

U.S. PATENT DOCUMENTS

| | | | |
|---|---|---|---|
| 1,385,955 | 7/1921 | Serruier | 353/79 |
| 2,127,590 | 8/1938 | Erwood | 353/17 |
| 2,258,782 | 10/1941 | McKean | 312/22 |
| 2,543,029 | 2/1951 | Kasler | 312/20 |

*Primary Examiner*—Casmir A. Nunberg
*Attorney, Agent, or Firm*—Sabin C. Bronson

[57] ABSTRACT

A relatively low, narrow, and long table, such as a coffee table, is provided, having a storage cabinet under each end of the table top for the storage of equipment, in this instance photographic equipment such as cameras, projectors, slide trays, motion picture film, etc., etc. This table is provided with a portion of the top at one end over one cabinet cut-out and hinged to the top so that it may be hinged to rest 180° in plane with the top and on which when thus extended, is a film or slide projector. The other end of the table top is also provided with a cut-out portion which is hinged to the end of a telescopically mounted section, slidable out the end of the table so that the cut-out portion may hinge upwardly to a vertical plane and act as a screen to receive pictures as projected from the projector at the other end of the table.

The table is on caster wheels so that it may be moved anywhere in a room for the convenience of all viewers.

1 Claim, 5 Drawing Figures

FIG. 1
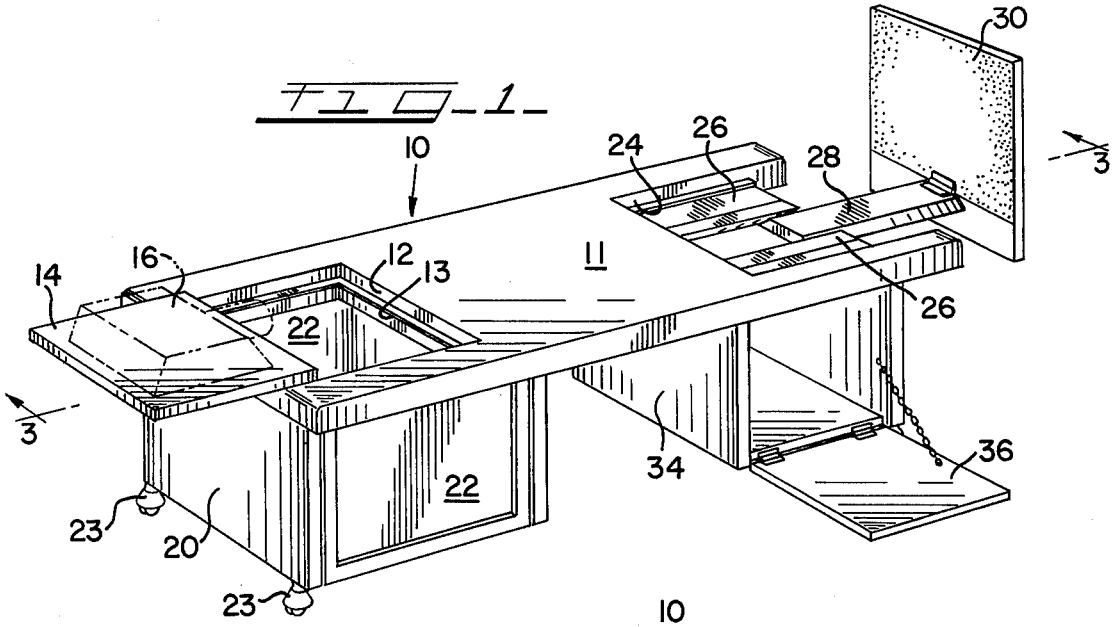
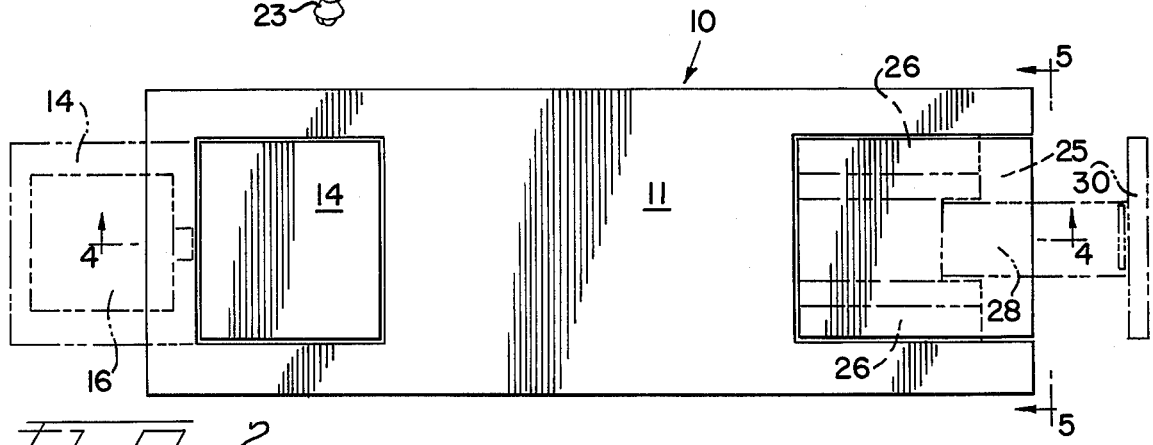
FIG. 2
FIG. 5
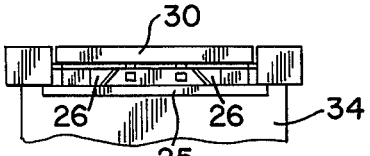
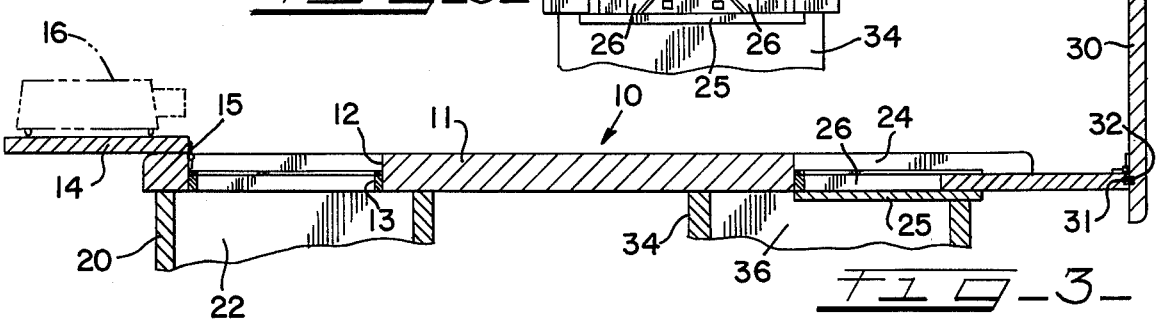
FIG. 3
FIG. 4
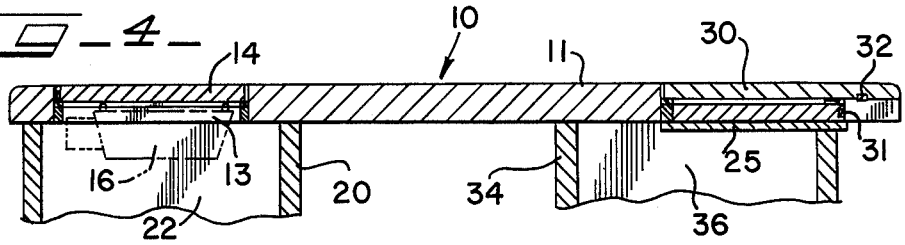

THEATER CABINET TABLE

BACKGROUND AND SUMMARY OF THE INVENTION

The purpose of the present invention is to provide a table from which slides may be projected on a screen for viewing by friends who may be visiting and wish to see the picture or film. In situations of this kind the host must get out the screen and set it up at the proper location. Then he must provide some support for the projector and finally get out the slides and see that they are in proper order. All this is annoying and time consuming, and this invention seeks to provide a table with everything necessary for picture projection therein, so that the table may be opened up as hereinafter described, the slides taken from the cabinet, and everything is in readiness for showing the picture in a matter of minutes. This is the principal object of the invention.

BRIEF DESCRIPTION OF THE DRAWINGS

Referring now to the drawings forming part of this application and wherein like reference characters indicate like parts:

FIG. 1 is a perspective view of a table with the parts open and ready for projecting slides or film on the screen.

FIG. 2 is a plan view of the table top showing the parts in closed position and indicating in dotted lines the open position of the projector and the screen.

FIG. 3 is a section on the line 3—3 of FIG. 1.

FIG. 4 is a section on the line 4—4 of FIG. 2.

FIG. 5 is an end view on the line 5—5 of FIG. 2.

DESCRIPTION OF THE PREFERRED EMBODIMENTS

Referring now in detail to the drawings, the table is indicated generally at 10 and is of the coffee table type, usually about two feet wide and six feet long, and quite low, occupying space usually in front of a davenport, or the like. When in closed position as shown in FIG. 2 it functions very well as a coffee table.

The table top is indicated at 11 and is of relatively thick material, about twice ordinary board thickness. At one end of the top there is a rectangular opening 12 therein, about the edges of which is fixed a narrow moulding 13 which forms a stop for the cover 14. Cover 14 is a rectangular piece of material, the same dimension of the opening, and hinged along one edge as at 15 to the corresponding edge of the opening so as to form a closure for the opening. When closed the cover 14 rests on the moulding 13 so as to be flush with the rest of the table top. When opened the cover rotates on the hinge 15 180° to the position shown in FIGS. 1 and 3. Removably mounted on the under side of the cover is a slide projector indicated in dotted lines at 16.

A rectangular cabinet 20, open at its top, is secured to the under side of the table top with opening 12 directly over the open top of the cabinet so that when the cover 14 is closed as shown in FIG. 4 the projector will have ample room in the cabinet, and the cover will be in plane with the rest of the table top. There is a door 22 at each end of the cabinet for access thereto from either end of the cabinet, or either side of the table. At the lower outer corners of the cabinet 20 are mounted casters 23 for convenience in moving the table from place to place.

At the other end of the table is provided another rectangular opening 24, and a rectangular plate 25 is secured to the margins of and directly under the opening 24 forming a bottom therefore. Along each side of said opening and on the plate 25 is a pair of guide rails 26, the spaced facing edges of which are chamfered diagonally downward as shown in FIG. 5. Slidably mounted between these strips is a main slide bar 28, the side edges of which are chamfered diagonally so as to fit and slide between the guide rails 26. At the outer end of the slide bar 28 is hingedly mounted the screen panel 30 so that it may swing from a horizontal position as shown in FIG. 4 to a vertical position as shown in FIGS. 1 and 3. Secured to the outer end of the slide bar, magnets 31 are provided so as to make contact with striker plates 32 on the screen panel when it is rotated 90° to a vertical position, and the magnets hold the same in that position as long as necessary.

The screen panel 30, guide rails 26 and slide bar 28, like the cover 14, are about half the thickness of the table top 11, so that when the parts are in closed position, as shown in FIGS. 2 and 5, they are flush with the table top, the screen panel 30 being the same size as the opening 24.

Immediately under the opening 24 and secured to the under side of the table top is another cabinet 34, the same size as the cabinet 20, and with like doors 36 at either end of the cabinet for easy access thereto. The cabinets provide space for the storage of slide trays, film, and other photographic needs for convenient access thereto when setting up to show pictures.

Under the outer lower corners of the cabinet 34, there are casters identical to the casters 23 for easy movement of the table from place to place as desired.

From the foregoing it is evident to one skilled in the art of photography, amateur or otherwise, that there is provided a means for the storage of photographic equipment and supplies in one convenient place, i.e., an article of living room furniture which may be set up in a matter of seconds, for the showing of slides or film, on a screen about the size of the average television screen available.

The distance from the projector to the screen is variable only to the extent the slide bar and screen is moved outwardly for sharp focusing and the projector is set for that distance, so that projected image distortion that usually accompanies other viewing systems because of the use of mirrors, magnifiers, and intermediate lenses, is avoided.

Other advantages of the system will be apparent to those versed in the art, as well as its adaptability to any photographer's present viewing system.

I claim:

1. A table having a top provided with openings in diametrically opposite sides thereof, covers mounted on said top to open or close said openings, a photographic projector removably mounted on the under side of one of said covers, and a photographic screen surface on the under side of the other cover, a support plate, secured to the under side of the table top, and spanning the opening for said other cover, a slide bar slidably mounted on the support plate, said other cover being hingedly mounted on the end of said slide bar and movable to a position vertical thereto, and catches on the slide bar engageable with catches on said other cover when in vertical position to hold said other cover in that position as long as desired.

* * * * *